US006720925B2

(12) United States Patent
Wong et al.

(10) Patent No.: US 6,720,925 B2
(45) Date of Patent: Apr. 13, 2004

(54) SURFACE-MOUNTABLE DUAL-BAND MONOPOLE ANTENNA OF WLAN APPLICATION

(75) Inventors: Kin Lu Wong, Kaohsiung (TW); Fa Shian Chang, Kaohsiung (TW)

(73) Assignee: Accton Technology Corporation, Hsinchu (TW)

( * ) Notice: Subject to any disclaimer, the term of this patent is extended or adjusted under 35 U.S.C. 154(b) by 48 days.

(21) Appl. No.: 10/141,112

(22) Filed: May 9, 2002

(65) Prior Publication Data

US 2003/0132883 A1 Jul. 17, 2003

(30) Foreign Application Priority Data

Jan. 16, 2002 (TW) ..... 91100833 A

(51) Int. Cl.[7] ..... H01Q 1/38
(52) U.S. Cl. ..... 343/700 MS; 343/702
(58) Field of Search ..... 343/700 MS, 702, 343/829, 767, 846; H01Q 1/38

(56) References Cited

U.S. PATENT DOCUMENTS

| | | | | | |
|---|---|---|---|---|---|
| 5,061,938 | A | * | 10/1991 | Zahn et al. | 343/700 MS |
| 5,633,646 | A | * | 5/1997 | Strickland | 343/700 MS |
| 5,668,557 | A | | 9/1997 | Kawahata | 343/700 MS |
| 5,952,975 | A | * | 9/1999 | Pedersen et al. | 343/702 |
| 6,100,849 | A | | 8/2000 | Tsubaki et al. | 343/700 MS |
| 6,121,932 | A | * | 9/2000 | McCoy et al. | 343/700 MS |
| 6,181,281 | B1 | * | 1/2001 | Desclos et al. | 343/700 MS |
| 6,307,512 | B1 | * | 10/2001 | Geeraert | 343/702 |
| 6,343,208 | B1 | * | 1/2002 | Ying | 455/575.7 |
| 6,392,605 | B2 | * | 5/2002 | Anterow | 343/702 |
| 6,448,932 | B1 | * | 9/2002 | Stoiljkovic et al. | 343/700 MS |
| 6,606,062 | B2 | * | 8/2003 | Ngounou Kouam et al. | 343/700 MS |

* cited by examiner

*Primary Examiner*—Tho Phan

(57) ABSTRACT

A surface-mountable dual-band monopole antenna includes a substrate and a folded radiative metallic patch with a small metallic lug. The folded radiative metallic patch encloses the substrate, and the small metallic lug protrudes from the substrate, wherein a feeding point is located on the small metallic lug for transmitting the signals.

17 Claims, 5 Drawing Sheets

SURFACE-MOUNTABLE DUAL-BAND MONOPOLE ANTENNA OF WLAN APPLICATION

BACKGROUND OF THE INVENTION

1. Field of the Invention

This present invention generally relates to an antenna for wireless communication system, and more particularly to a surface-mountable dual-band monopole antenna for wireless local area network system which can be easily fabricated at a lower cost, has better antenna bandwidth and gain, and is adapted to operate in two separate bands.

2. Description of the Related Art

The construction of wireless local area network (WLAN) makes the integration of the signals and data from a variety of multimedia devices possible, and the connection among a plurality of devices is no more limited to the specific ports with wire transmission. In the meanwhile, in order to enhance the convenience and portability, "light, thin, short, and small" have become the design standards of related components. The design of the antenna must conform to the aforementioned standards as well. In addition, whether an antenna can be assembled simply or not is also a big concern for antenna designing. With the rapid development in the surface mountable technique (SMT), the antenna applied to SMT can be assembled simply, and be packaged and connected at a lower cost. So, the surface-mountable antenna has attracted considerable attention. The conventional surface-mountable antenna is printed on the ceramic substrate, such as U.S. Pat. No. 5,668,557 issued to Kawahata on Jul. 16, 1997 entitled "Surface-mount antenna and communication device using same" which discloses a surface-mountable antenna, wherein the dielectric substrate thereof is made of a ceramic material. However, it is very difficult for the aforementioned antenna to obtain better antenna bandwidth and gain. Besides, the fabrication of the structure is quite difficult and complicated and the cost of the structure is high. Moreover, U.S. Pat. No. 6,100,849 issued to Tsubaki et al. on Aug. 8, 2000 entitled "Surface mount antenna and communication apparatus using the same" discloses a surface-mountable antenna of which the dielectric substrate is also made of a ceramic material. Compared with the aforementioned antenna, the fabrication of the antenna of Tsubaki et al. is easier. However, the ceramic material thereof is not only expensive but also fragile in the surface-mountable processes. In addition, the dielectric constant is relatively high, generally larger than 7, thereby significantly reducing the bandwidth and gain of the antenna as well as its competition with other products.

Moreover, the conventional antenna of the wireless network card equipped in a variety of electronic products can operate in a single band only. It can be expected that the performance and competitiveness of such an antenna will be inadequate for the prosperous market. So it will be the principal tendency to develop a dual-band antenna for applications in the wireless network cards.

Accordingly, it is necessary to provide an antenna for a wireless communication system which is surface mountable on the circuit board, and can be easily fabricated at a lower cost. The dielectric substrate thereof can provide better antenna bandwidth and gain, and the antenna can be adapted to operate in dual bands for wireless local area network (WLAN) operations.

SUMMARY OF THE INVENTION

It is a primary object of the present invention to provide a surface-mountable dual-band monopole antenna which is easily fabricated at a lower cost, and the dielectric substrate thereof can provide better antenna bandwidth and gain.

It is another object of the present invention to provide a surface-mountable dual-band monopole antenna adapted to operate in dual bands for WLAN operations.

To achieve the aforementioned objects, the present invention provides a surface-mountable dual-band monopole antenna comprising a substrate and a folded radiative metallic patch with a small metallic lug protruding outwardly from the substrate. A feeding point is located on the small metallic lug for transmitting the signals.

According to another aspect of the present invention, the folded radiative metallic patch encloses at least three surfaces of the substrate.

According to a further aspect of the present invention, the substrate is an air layer or it is made of the material of which dielectric constant is close to that of the air.

According to a still further aspect of the present invention, the substrate has a low rectangular-pillar profile.

According to a still further aspect of the present invention, the folded radiative metallic patch is folded from a planar metallic patch having a rectangular or substantially rectangular shape.

According to a still further aspect of the present invention, the planar metallic patch has at least one slot extending from one edge of the planar metallic patch to the interior of the planar metallic patch to constitute a first path and a second path on the planar metallic patch, wherein the first path is for the electric current path of the two operating frequencies of the surface-mountable dual-band monopole antenna and the second path is used to tune the impedance matching of the antenna.

According to a still further aspect of the present invention, the two operating frequencies comprise a higher frequency and a lower one which are the first two resonant frequencies of the surface-mountable dual-band monopole antenna.

According to a still further aspect of the present invention, the first path has a starting point and an end point. The starting point is the feeding point of surface-mountable dual-band monopole antenna, and the first path has a turn of 180° or substantially 180° to enable the end point to extend towards the direction of the starting point.

BRIEF DESCRIPTION OF THE DRAWINGS

Other objects, advantages, and novel features of the invention will become more apparent from the following detailed description when taken in conjunction with the accompanying drawings.

DETAILED DESCRIPTION OF THE PREFERRED EMBODIMENT

Figure 1:
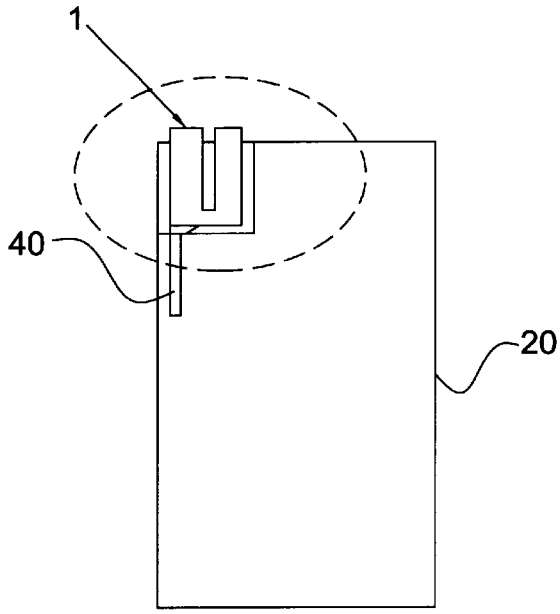
FIG. 1 is a plan view showing a surface-mountable dual-band monopole antenna of a preferred embodiment of the present invention disposed on a microwave substrate.

While the present invention is susceptible of embodiments in various forms, the embodiments shown in the drawings and hereinafter described are preferred ones. It is to be understood that the present disclosure is to be considered as an exemplification of the invention and is not intended to limit the invention to the specific embodiments illustrated.

As shown in FIG. 1, a surface-mountable dual-band monopole antenna 1 of the present invention is disposed on a microwave substrate 20, accomplished in the form of a circuit board with a dimension of 40×100 $mm^2$ having a variety of wireless communication components thereon. The surface-mountable dual-band monopole antenna 1 is printed on a corner of the microwave substrate 20.

Figure 2:
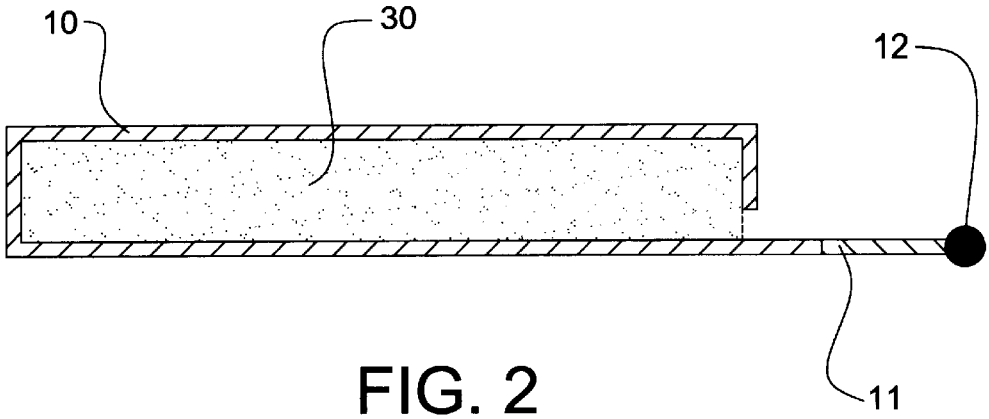
FIG. 2 is a side view of a surface-mountable dual-band monopole antenna of a preferred embodiment of the present invention.

Referring to FIG. 2, it depicts a side view of a preferred embodiment of a surface-mountable dual-band monopole antenna 1 of the present invention. The surface-mountable dual-band monopole antenna 1 mainly comprises a substrate 30 made of an air layer or the other material of which dielectric constant is close to that of air and generally less than 2, such as plastic, and having a low rectangular-pillar profile, a folded radiative metallic patch 10 enclosing four surfaces of the substrate 30 and having a small metallic lug 11 protruding outwardly from the substrate 30 about 1 mm for tuning the impedance matching of the surface-mountable dual-band monopole antenna 1, and a feeding point 12 located on the small metallic lug 11 for transmitting the signals.

As previously explained, the fabrication cost of the substrate 30 is much lowered as compared with the conventional ceramic substrate because the substrate 30 are made of an air layer or the other material of which dielectric constant is close to that of air, such as plastic. Besides, better antenna bandwidth and gain of the surface-mountable dual-band monopole antenna 1 can be obtained because the dielectric constant is generally less than 2 (as shown from FIG. 5 to FIG. 7). In addition, the folded radiative metallic patch 10 is only required to enclose the substrate 30, rather than to be printed on the substrate 30.

Figure 3:
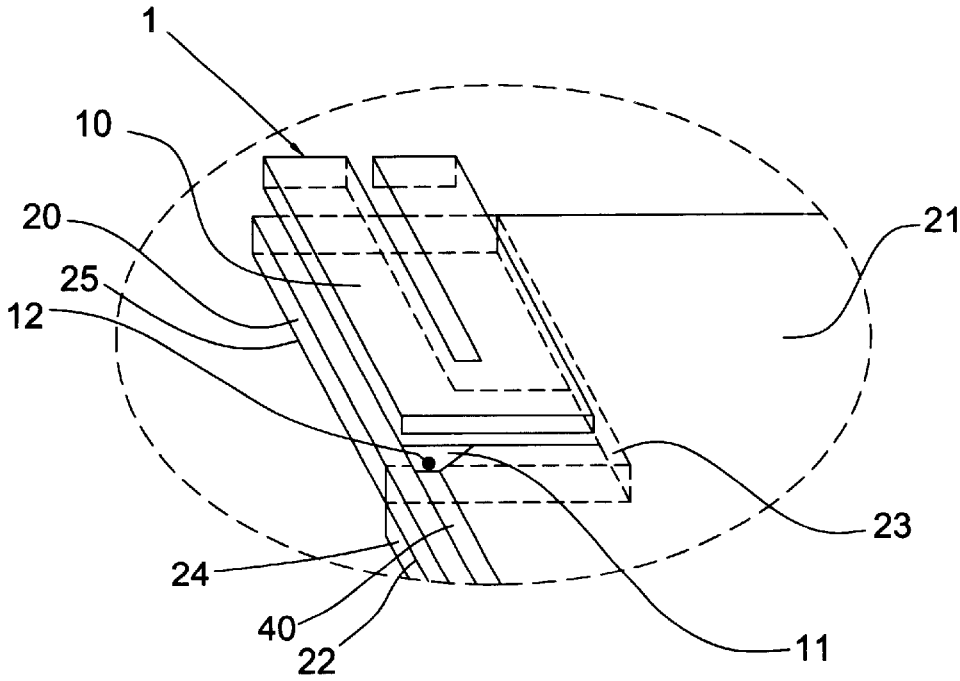
FIG. 3 is a perspective view showing a surface-mountable dual-band monopole antenna of an embodiment of the present invention disposed on a microwave substrate.

Referring to FIG. 3, the microwave substrate 20 comprises a first surface 21 and a second surface 22, wherein an adhesive section 23 and a 50 Ω microstrip line 40 are disposed on the first surface 21, a ground plane 24 is printed on the second surface 22 with a rectangular breach 25 corresponding to the adhesive section 23. According to the present invention, the microwave substrate 20 is accomplished in the form of a printed circuit board (PCB) made of BT (bismaleimide-triazine) epoxy or FR4 (fiberglass reinforced epoxy resin), or a flexible film substrate made of polyimide. As shown in FIG. 3, the surface-mountable dual-band monopole antenna 1 of the present invention is mounted on the first surface 21 of the microwave substrate 20 by the surface mountable technique (SMT), wherein the feeding point 12 is connected to the 50 Ω microstrip line 40 to transmit the signals.

Figure 4:
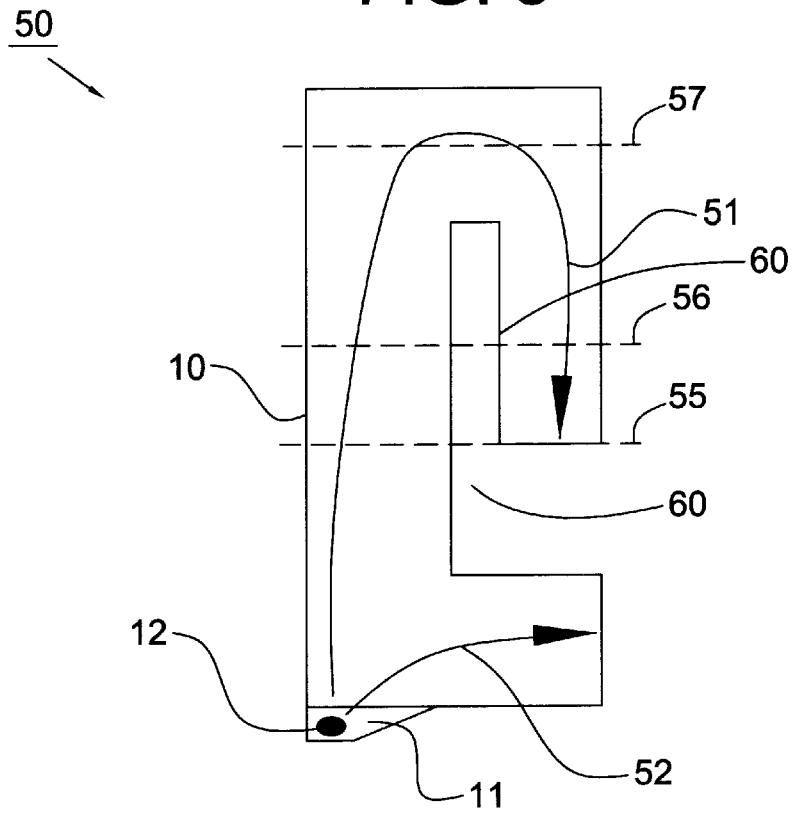
FIG. 4 is a plan view of an unfolded planar metallic patch for the folded radiative metallic patch of an embodiment of the present invention.

Referring to FIG. 4, in accordance with a preferred embodiment of the present invention, the folded radiative metallic patch 10 of the surface-mountable dual-band monopole antenna 1 is formed with a planar metallic patch 50 which has a rectangular or substantially rectangular shape, and is folded according to and along the folding lines 55, 56, and 57. The planar metallic patch 50 has an L-shaped slot 60 extending from one edge of the planar metallic patch 50 to the interior of the planar metallic patch 50 to constitute a first path 51 and a second path 52 on the planar metallic patch 50. The first path 51 is applied to two operating frequencies of the surface-mountable dual-band monopole antenna 1 of the present invention, being the first two resonant frequencies of the surface-mountable dual-band monopole antenna 1, and comprising a higher frequency and a lower one. The first path 51 includes a starting point and an end point, wherein the starting point is the feeding point 12. The first path 51 has a turn of 180° or substantially 180° to enable the end point to extend towards the direction of the starting point. The second path 52 is applied to tune the impedance matching of the surface-mountable dual-band monopole antenna 1 such that no other conventional impedance matching circuits are required. In addition, in accordance with a preferred embodiment of the present invention, the planar metallic patch 50 is 0.2 mm in thickness, whereby a good rigidity of the folded radiative metallic patch 10 is obtained. Using a thicker metallic patch, the rigidity can be enhanced to such an extent that the surface-mountable dual-band monopole antenna 1 of the present invention is more suitable for the application of SMT, and the substrate 30 can consist of the air only, without any other materials.

Figure 5:
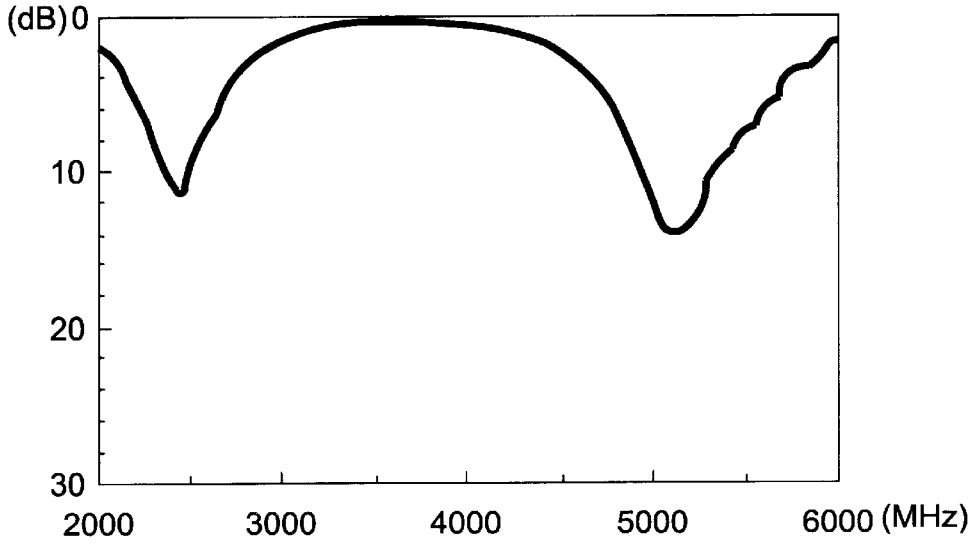
FIG. 5 is an experimental result of the return loss of a surface-mountable dual-band monopole antenna of the present invention.
Figure 6:
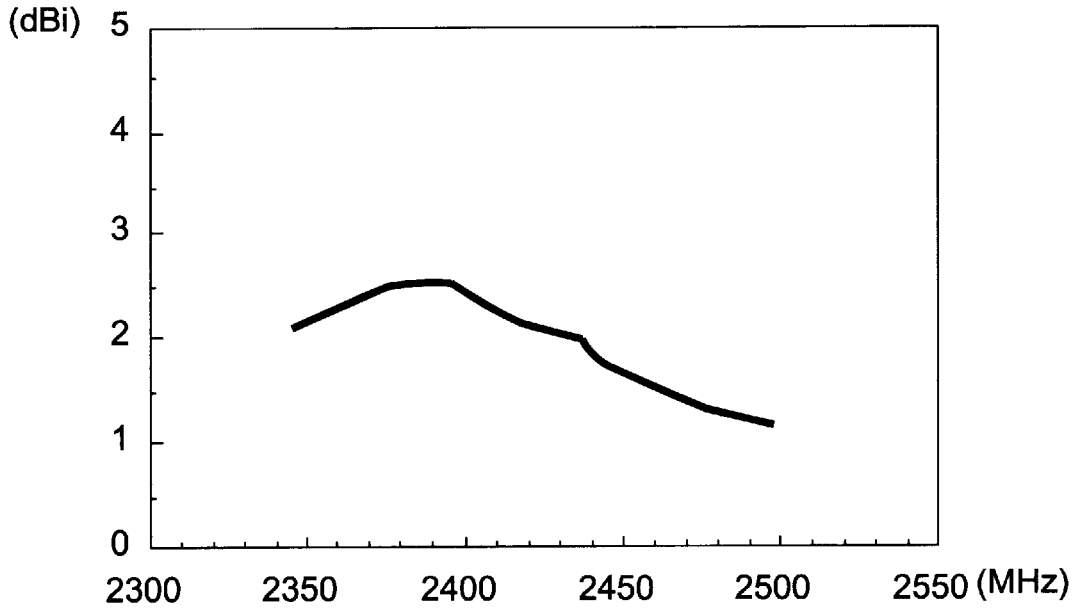
FIG. 6 is an experimental result of the gain of a surface-mountable dual-band monopole antenna of the present invention operated in the 2.4 GHz WLAN band.
Figure 7:
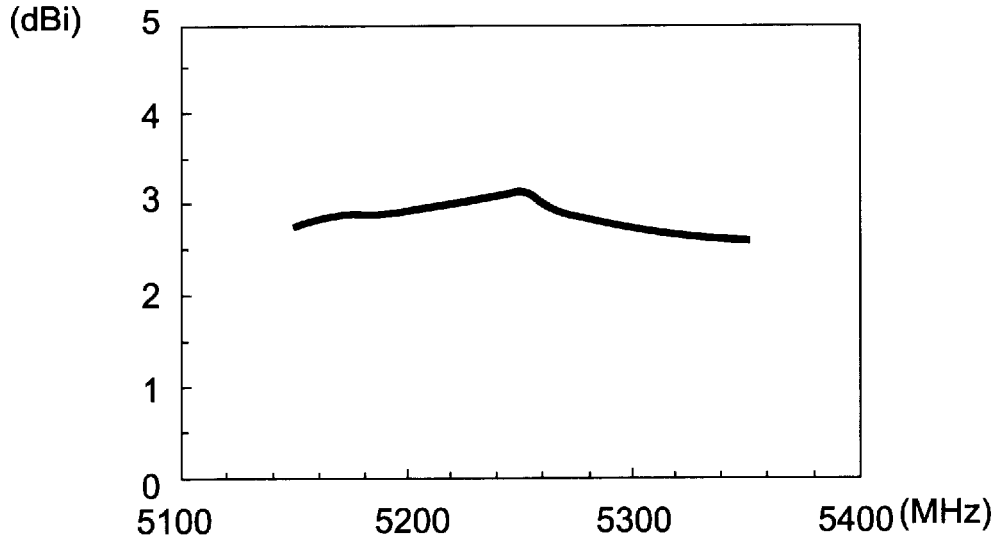
FIG. 7 is an experimental result of the gain of a surface-mountable dual-band monopole antenna of the present invention operated in the 5.2 GHz WLAN band.

FIG. 5, FIG. 6 and FIG. 7 show the experimental results of the surface-mountable dual-band monopole antenna 1 in accordance with FIG. 1, FIG. 2, and FIG. 3. With a microwave substrate 20 having a relative dielectric constant of 4.4, a dimension of 40×100 $mm^2$, and a thickness of 0.8 mm, an adhesive section 23 having a dimension of 10×10 $mm^2$, and an antenna having a length of 12 mm, a width of 8 mm, a height of 3 mm, disposed on the microwave substrate 20 and protruding out of the microwave substrate 20 about 2 mm (The antenna can also be entirely disposed within the microwave substrate 20 with an adhesive section 23 having dimensions of 12×10 $mm^2$), the experimental results as shown in FIG. 5, FIG. 6, and FIG. 7 can be obtained.

FIG. 5 depicts the experimented results of the return loss under the definition of 10 dB return loss, wherein the antenna impedance bandwidth covers the 2.4 GHz (2400–2484 MHz) and 5.2 GHz (5150–5350 MHz) bands for WLAN operations. As shown in FIG. 6, the maximum antenna gain can reach 2.8 dBi in the 2.4 GHz band. As shown in FIG. 7, the maximum antenna gain can reach 3.1 dBi in the 5.2 GHz band.

Figure 8A:
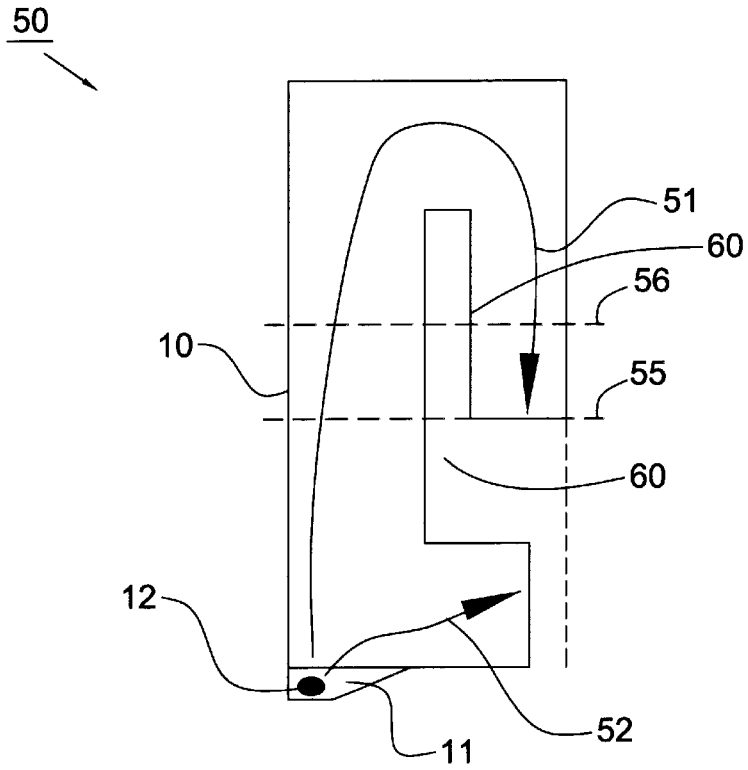
FIG. 8*a* and FIG. 8*b* are plan views of other embodiments of an unfolded planar metallic patch for the folded radiative metallic patch of an embodiment of the present invention.
Figure 8B:
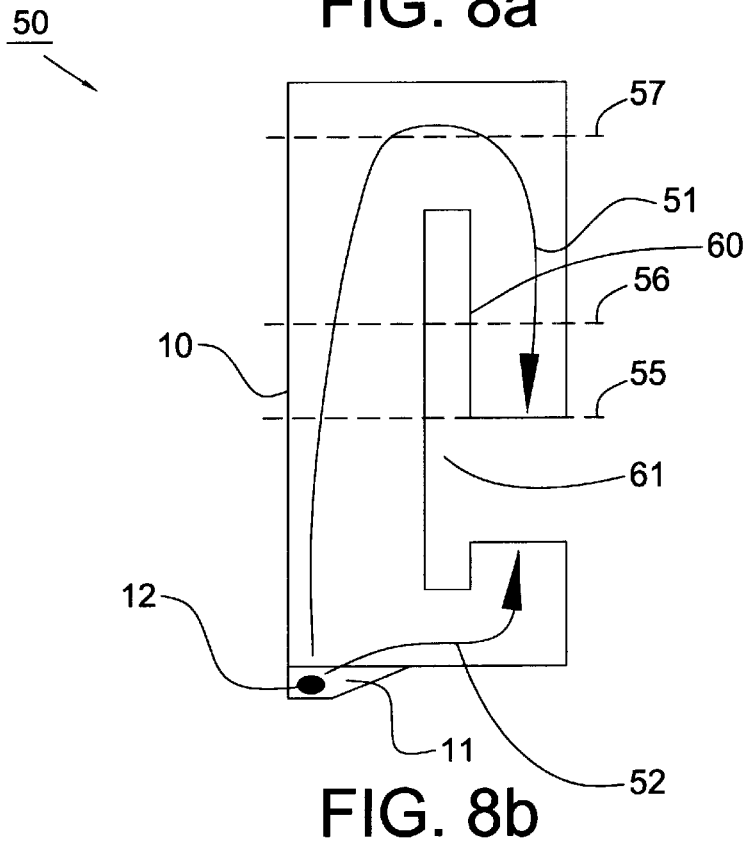

FIG. 8*a* and FIG. 8*b* show the plan views of the unfolded planar metallic patch 50 for the folded radiative metallic patch 10 of the surface-mountable dual-band monopole antenna 1 of another embodiments of the present invention. As shown in FIG. 8*a*, the planar metallic patch 50 has a substantially rectangular shape with folding lines 55, 56 and an L-shaped slot 60. The L-shaped slot 60 extending from one edge of the planar metallic patch 50 to the interior of the planar metallic patch 50 to constitute the first path 51 and the second path 52 on the planar metallic patch 50. Because the planar metallic patch 50 only has two folding lines 55 and 56, it only needs to enclose three surfaces of the substrate 30, i.e. the methods for fabricating the planar metallic patch 50 for the folded radiative metallic patch 10 will be simpler. Moreover, compared with FIG. 2, the second path 52 can freely adjust its path length and thus the end point thereof is not required to flush with the edge of the planar metallic patch 50 so as to be even more suitable for the impedance matching of the surface-mountable dual-band monopole antenna 1.

As shown in FIG. 8*b*, the planar metallic patch 50 has a substantially rectangular shape with folding lines 55, 56, and 57 and a T-shaped slot 61. The T-shaped slot 61 extends from one edge of the planar metallic patch 50 to the interior of the planar metallic patch 50 to constitute the first path 51 and the second path 52 on the planar metallic patch 50, wherein the second path 52 has a bent portion so as to be even more suitable for the impedance matching of the surface-mountable dual-band monopole antenna 1.

While the foregoing description and drawings represent the preferred embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure arrangement, proportions, materials, elements, and components and otherwise, used in the practice of the invention, which are particularly adapted to specific environments and operating requirements without departing from the principles of the present invention. The presently disclosed embodiments are therefore to be considered in all respects as illustrative and not restrictive, the scope of the invention being indicated by the appended claims and their legal equivalents, and not limited to be the foregoing description.

What is claimed is:

1. A dual-band monopole antenna comprising:

a substrate;

a planar metallic patch surface-mounted on at least three sides of the substrate for generating a first frequency band and a second frequency band, the planar metallic patch having a substantially rectangular shape with a slot of substantially "L" shape to form a relatively long free end and a relatively short free end; and a feeding point coupled to the relatively short free end for signal transmission.

2. The dual-band monopole antenna as claimed in claim 1, further comprising:

a metallic lug protrusive to the relatively short free end for impedance matching.

3. The dual-band monopole antenna as claimed in claim 1, wherein the substrate is made of a material having dielectric constant similar to that of air.

4. The dual-band monopole antenna as claimed in claim 1, wherein the first frequency band and the second frequency band are determined by a resonant path extending from the feeding point and along the slot to the relatively long free end of the planar metallic patch.

5. The dual-band monopole antenna as claimed in claim 1, wherein the first frequency band is at about 2.4 GHz.

6. The dual-band monopole antenna as claimed in claim 1, wherein the second frequency band is at about 5.2 GHz.

7. An antenna structure for wireless communication comprising:

a card adapted to a wireless device;

at least one substrate formed on one side of the card; and at least one antenna surface-mounted on the at least one substrate, the at least one antenna having a planar metallic patch surface-mounted on at least three sides of the at least one substrate for generating a first frequency band and a second frequency band, the planar metallic patch having a substantially rectangular shape with a slot of substantially "L" shape to form a relatively long free end and a relatively short free end each spaced apart, and a feeding point coupled to the relatively short free end for signal transmission.

8. The antenna structure for wireless communication as claimed in claim 7, wherein the substrate is made of a material having dielectric constant similar to that of air.

9. The antenna structure for wireless communication as claimed in claim 7, wherein the first frequency band and the second frequency band are determined by a resonant path extending from the feeding point and along the slot to the relatively long free end of the planar metallic patch.

10. The antenna structure for wireless communication as claimed in claim 7, wherein the relatively short free end of the planar metallic patch is for impedance matching.

11. The antenna structure for wireless communication as claimed in claim 7, wherein the first frequency band is at about 2.4 GHz.

12. The antenna structure for wireless communication as claimed in claim 7, wherein the second frequency band is at about 5.2 GHz.

13. A method of forming a dual-band monopole antenna structure comprising the steps of:

providing a substrate, and a planar metallic patch of substantially rectangular in shape;

patterning a slot of substantially "L" shape on the planar metallic patch to form a relatively long free end and a relatively short free end;

folding and surface-mounting the patterned planar metallic patch on at least three sides of the substrate to generate a first frequency band and a second frequency band;

coupling a feeding point to the relatively short free end for signal transmission; and using the relatively short free end for impedance matching.

14. The method of forming a dual-band monopole antenna as claimed in claim 13, further comprising the step of:

providing a metallic lug protrusive to the relative short free end for mounting the feeding point.

15. The method of making a dual-band monopole antenna as claimed in claim 13, wherein the first frequency band is at about 2.4 GHz.

16. The method of making a dual-band monopole antenna as claimed in claim 13, wherein the second frequency band is at about 5.2 GHz.

17. The method of making a dual-band monopole antenna as claimed in claim 13, wherein the planar metallic patch is protrusive to the substrate when surface mounting on the substrate.

* * * * *